US005941574A

United States Patent [19]

Hamilton et al.

[11] Patent Number: 5,941,574

[45] Date of Patent: Aug. 24, 1999

[54] HORIZONTAL PENETRATOR WITH MULTIPLE METAL SEALING PRESSURE LINES

[75] Inventors: Scott Mitchell Hamilton, Landark; Michael Robert Tierney, Millburn, both of United Kingdom

[73] Assignee: FMC Corporation, Chicago, Ill.

[21] Appl. No.: 08/867,685

[22] Filed: May 29, 1997

[30] Foreign Application Priority Data

May 31, 1996 [GB] United Kingdom ..... 9611375

[51] Int. Cl.[6] ..... F16L 37/12

[52] U.S. Cl. ..... 285/3; 285/35; 285/322; 285/922

[58] Field of Search ..... 285/3, 33, 34, 285/35, 322, 323, 922

[56] References Cited

U.S. PATENT DOCUMENTS

| | | | |
|---|---|---|---|
| 2,820,481 | 1/1958 | Hix | 285/35 |
| 3,071,188 | 1/1963 | Raulins | 285/34 |
| 3,100,655 | 8/1963 | Work | 285/33 |
| 3,345,084 | 10/1967 | Hanes et al. | 285/34 |
| 3,757,836 | 9/1973 | Masuda | 285/35 |
| 3,912,009 | 10/1975 | Davis, Jr. | 285/34 |
| 4,364,587 | 12/1982 | Samford | 285/35 |
| 4,452,472 | 6/1984 | Crase | 285/922 |
| 4,543,995 | 10/1985 | Weh et al. | 285/35 |
| 4,593,937 | 6/1986 | Schawann et al. | 285/33 |

FOREIGN PATENT DOCUMENTS

| | | | |
|---|---|---|---|
| 3639528 | 11/1987 | Germany | 285/35 |
| 1433453 | 4/1976 | United Kingdom . | |
| 2205370 | 7/1988 | United Kingdom . | |

*Primary Examiner*—Eric K. Nicholson
*Attorney, Agent, or Firm*—Henry C. Query, Jr.

[57] ABSTRACT

A coupler 10 for pressure conduits 12*a–d* comprises movable components 22, 26 selectively engageable with or disengageable from fixed components 34 to provide disconnectable sealed pressure connections therewith, the moveable components 22 being acted upon by a primary actuator comprising a bearing plate 52, a thrust nut 50 and a threaded drive spindle 44. Spindle 44 is mounted in an end cap 46 normally held fixed relative to the fixed components by collet fingers 66 but which is disengageable from a connector body 14 upon withdrawal of a retainer sleeve (70, FIG. 8) so as to provide secondary actuation of the movable components 22, 26 independently of the primary actuator 44, 50, 52.

10 Claims, 6 Drawing Sheets

FIG 4
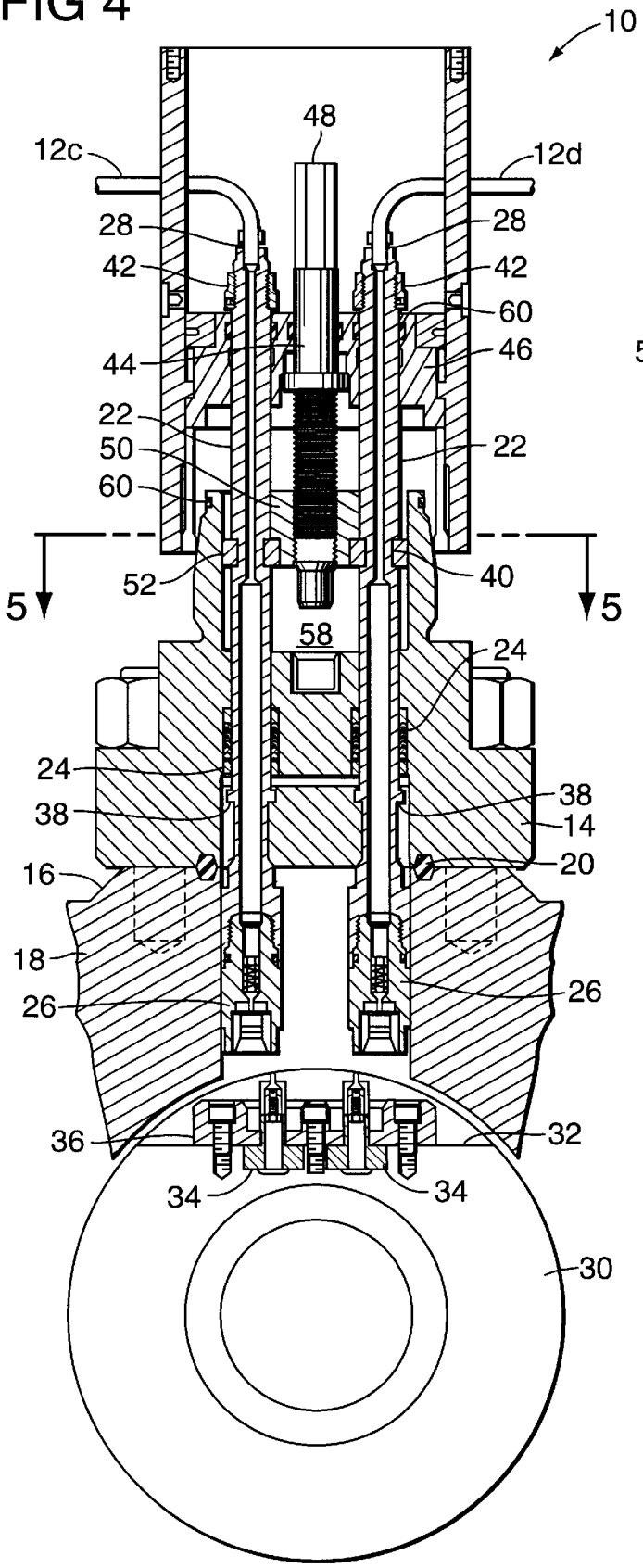
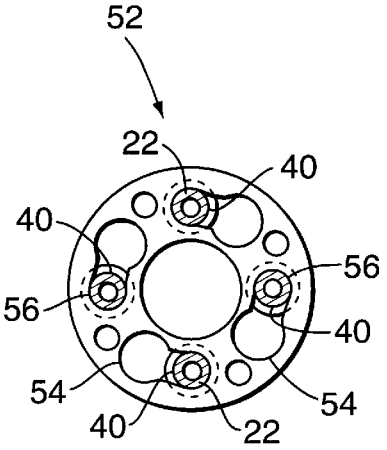
FIG 5

HORIZONTAL PENETRATOR WITH MULTIPLE METAL SEALING PRESSURE LINES

BACKGROUND OF THE INVENTION

This invention relates to equipment which may be used amongst other purposes for controlling the production flow from subsea oilwells. More specifically it relates to couplers which may be used in pressure containing conduits extending between a tubing hanger and a horizontal Christmas tree.

In subsea oilwells there is a requirement to provide a hydraulic communication line to a surface controlled subsurface safety valve (SCSSV) located within the well for controlling production flow. A second line may be provided to the SCSSV to allow flushing and circulation/replacement of the control fluid. Additional pressure lines may be present for chemical injection or control or monitoring of other downhole equipment. To cater for maximum variation in chemical and fluid composition in the lines it is desirable that metal to metal primary seals should be used.

With a horizontal Christmas tree system, the pressure lines must come from within the tubing hanger and completion equipment out through the Christmas tree. Pressure line connections must be made up after or during installation of the tubing hanger which occurs after the Christmas tree has been installed. There are various known arrangements for providing such connections. In a first arrangement, a circumferential sealed pressure gallery extends between ports in the tubing hanger and Christmas tree. This design is limited by the space required which restricts the number of pressure lines and the facility for backup seals. A second arrangement has angled couplers upstanding from the tubing hanger and/or Christmas tree which are made up automatically as the tubing hanger is installed (i.e. tubing hanger weight set). This design may require complex machining internal to the Christmas tree and tubing hanger. A third arrangement is a single pressure line coupler movable in and out of mating engagement with the tubing hanger by a manual actuator mechanism. The problems in this design are in providing a dynamic seal between the movable coupler and stationary pressure line to accommodate the actuator stroke. This effectively precludes the use of metal to metal seals throughout the coupler. The actuator mechanism must also be made highly reliable as the coupler has to be retracted to allow retrieval of the tubing hanger. Failure of the actuator mechanism with the coupler extended will lead to severe problems in removing the tubing hanger from the Christmas tree.

SUMMARY OF THE INVENTION

The present invention aims to overcome at least some of the foregoing problems and in a first aspect provides a coupler for a pressure conduit comprising a movable component selectively engageable with and disengageable from a fixed component to provide a disconnectable sealed pressure connection therewith, the movable component being acted upon by a primary actuator connected to a mounting normally held fixed relative to the fixed component but being movable relative to the fixed component to provide secondary actuation of the movable component independently of the primary actuator. In this way the movable component can be disengaged from the fixed component by movement of the mounting if the primary actuator fails.

Preferably the actuator and advantageously also the mounting can be operated for movement by a remotely operated vehicle (ROV). For example the actuator may include a ROV torque drive connection. The mounting may include a collet having fingers held in engagement with a fixed body by a retainer sleeve. The retainer sleeve may be shear pinned to the collet and also coupled to the collet by a lost motion connection, whereby pulling on the sleeve will first break the shear pins allowing the sleeve to move and release the fingers for disengagement from the body and then pull the collet from the body by means of the lost motion connection.

The actuator may comprise a screw threaded spindle or drive sleeve axially fixed for rotation within the mounting and carrying a complimentary drive nut or screw threaded spindle to which the movable component is connected. A plurality of fixed components may be provided, engageable by a corresponding plurality of movable components. The drive nut or spindle may carry a bearing plate having bayonet connection apertures engageable with thrust shoulders on the movable components.

Preferably the movable and fixed components are located in a sealed chamber provided in a Christmas tree and tubing hanger assembly, the chamber providing a backup seal for the coupler.

In a second independent aspect the present invention provides a coupler for a pressure conduit comprising a movable component selectively engageable with and disengageable from a fixed component to provide a disconnectable metal to metal sealed pressure connection therewith, the movable component including a through passage extending from the pressure connection and sealingly connected at its opposite end to a metal conduit sufficiently flexible to permit movement of the movable component for said selective engagement and disengagement. In this way dynamic seals are avoided and metal to metal primary seals can be used throughout the coupler.

BRIEF DESCRIPTION OF THE DRAWING

The invention and its preferred features will be further understood from the following description of illustrative embodiments made with reference to the drawings in which:

FIG. 4 is a section on line 2—2 in FIG. 1 showing the coupler in a secondary release position;

FIG. 5 is a section on line 5—5 in FIG. 4 showing a bearing plate with bayonet connection apertures;

DESCRIPTION OF THE PREFERRED EMBODIMENTS

Figure 1:
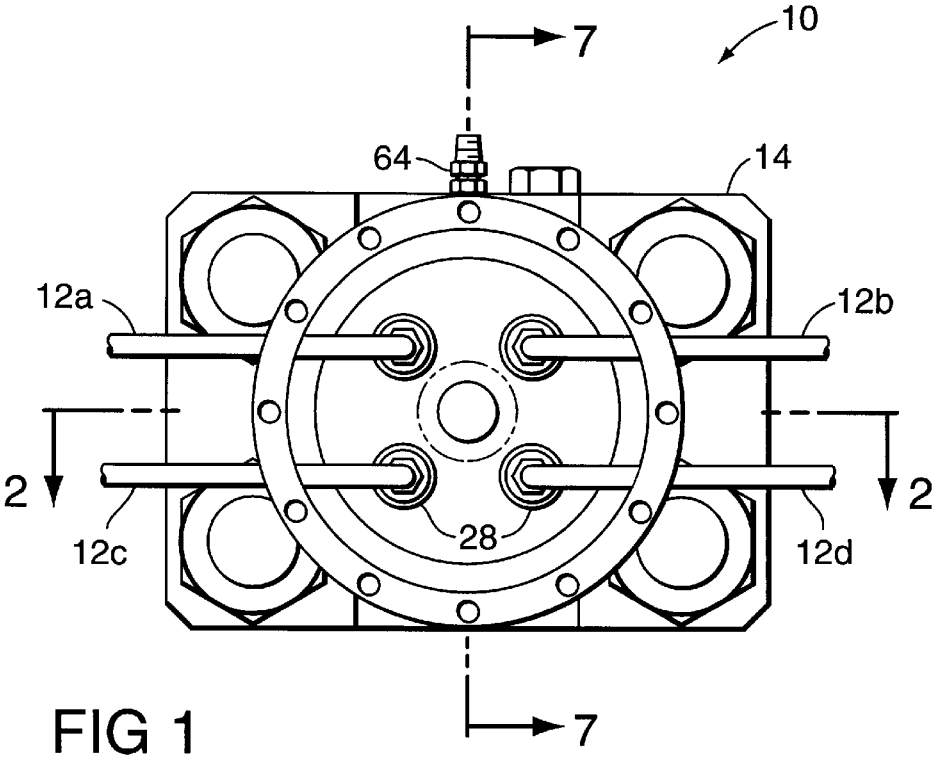
FIG. 1 is an end view of a coupler forming a first embodiment of the invention.

FIGS. 1–7 show a retractable coupler 10 for four pressure lines 12*a*–*d*. The invention may however be applied to greater or fewer pressure lines. A main body 14 is bolted onto a bonnet flange location 16 of a Christmas tree 18 to which it is sealed by a ring gasket 20. The body 14 supports four coupler stems 22 for axial movement. The stems 22 are sealed to the body by packings 24 for example of the kind disclosed in our European patent no. 0187896. The stems 22 are of one piece construction with a National Coupling Co. Inc. metal sealing female coupler component 26 (as disclosed for example in U.S. Pat. No. 4,694,859) on one end and a ⅜" M/P metal sealing Butech pipe fitting 28 on the other end for connection to the pressure lines 12*a–d*. The stems 22 are hollow to provide fluid communication between the lines 12*a–d* and the coupler components 26.

A tubing hanger 30 is received within the Christmas tree 18 and has a recess 32 machined in its outer surface. Four National Coupling Co. Inc. metal sealing male coupler components 34 are held in the recess 32 in axial alignment with the female coupler components 26, by a retaining plate 36. The recess 32 forms part of a gallery around the tubing hanger isolated by upper and lower s-seals (not shown). The compartment housing the coupler components 26, 34 is therefore fully sealed, meaning that the design will still operate effectively with one coupler leaking. The coupler compartment is capable of holding pressures up to 15000 psi (103 $MNm^{-2}$).

The stems 22 each include a backstop 38, a thrust groove 40 for actuation and an external thread on the outside end for fitting a nut 42 which is used for withdrawing the stems via a secondary release mechanism as described below.

A threaded drive spindle 44 is held axially fixed for rotation in an end cap mounting 46 which includes apertures through which the outer ends of the stems 22 pass, as well as a central aperture from which a hexagonal drive formation 48 on the spindle 44 protrudes for attachment to an extension piece (not shown). The distal end of the extension piece terminates in a standard drive formation at an ROV panel.

Figure 7:
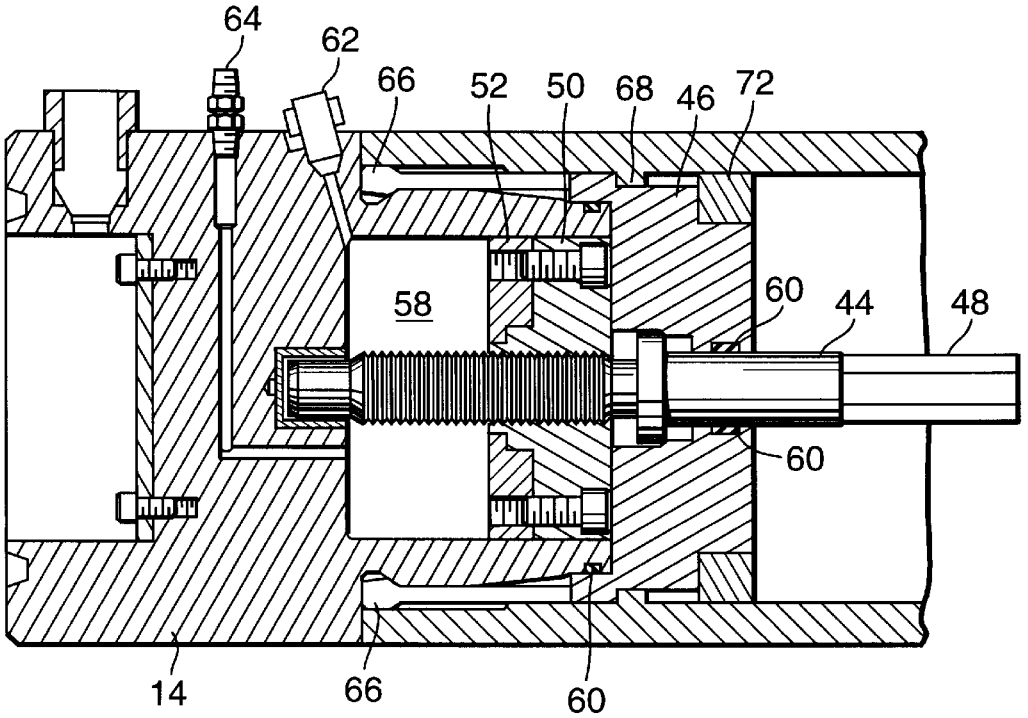
FIG. 7 is an enlarged section on line 7—7 in FIG. 1.
Figure 2:
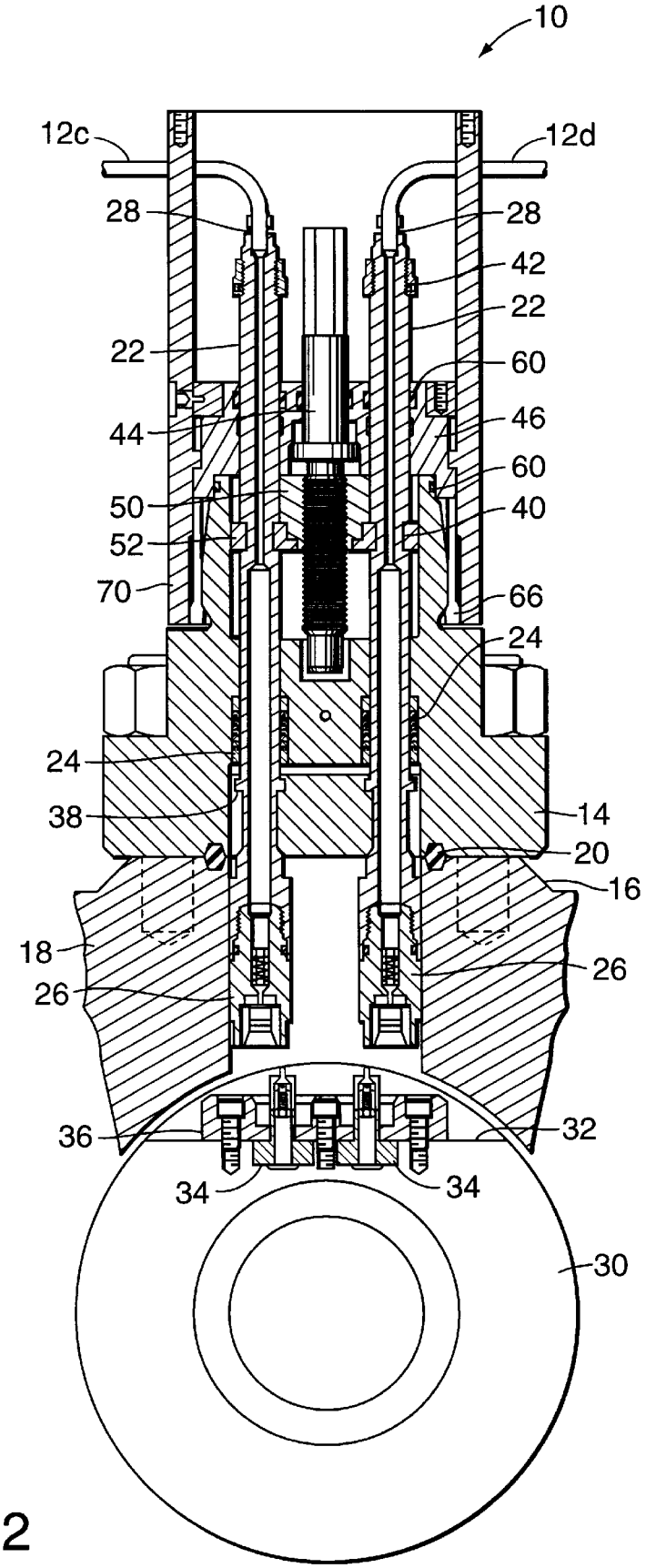
FIG. 2 is a section on line 2—2 in FIG. 1 showing the coupler in the disengaged position.
Figure 3:
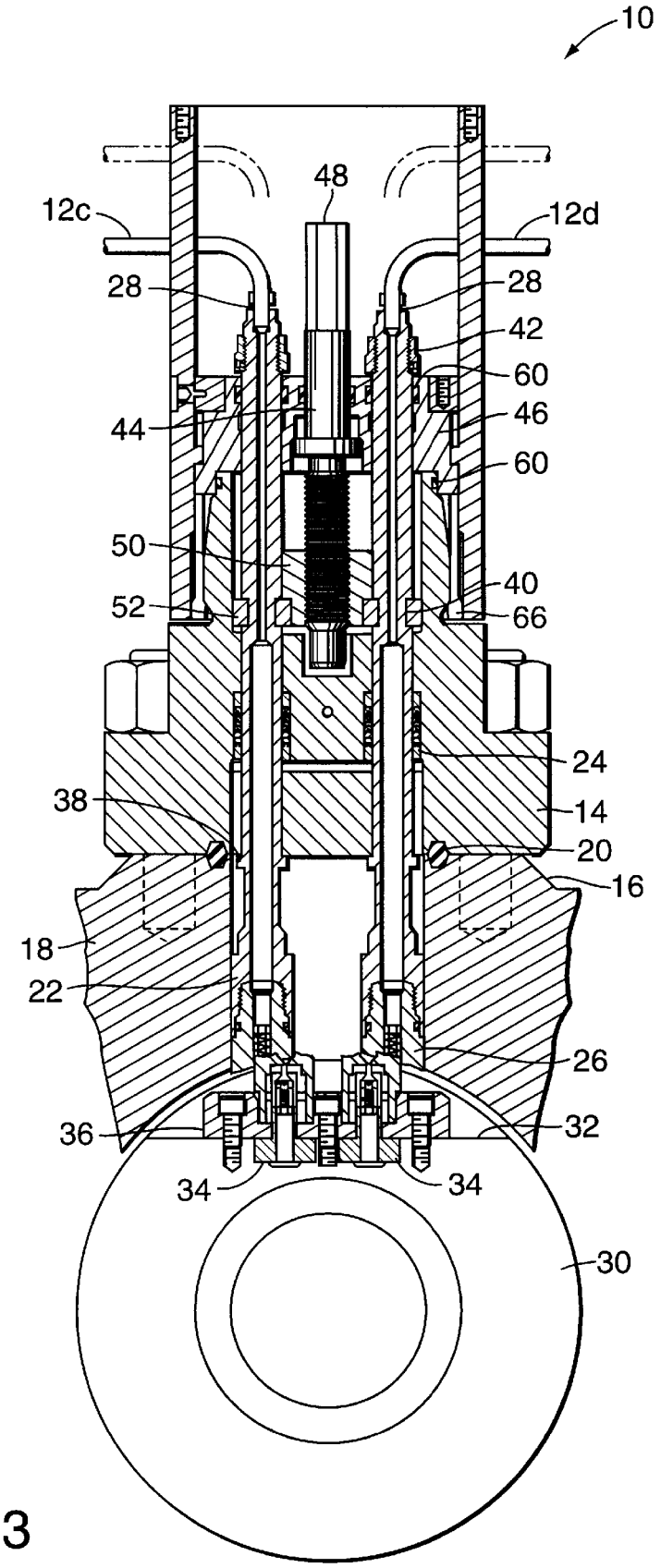
FIG. 3 is a section on line 2—2 in FIG. 1 showing the coupler in the engaged position.
Figure 6:
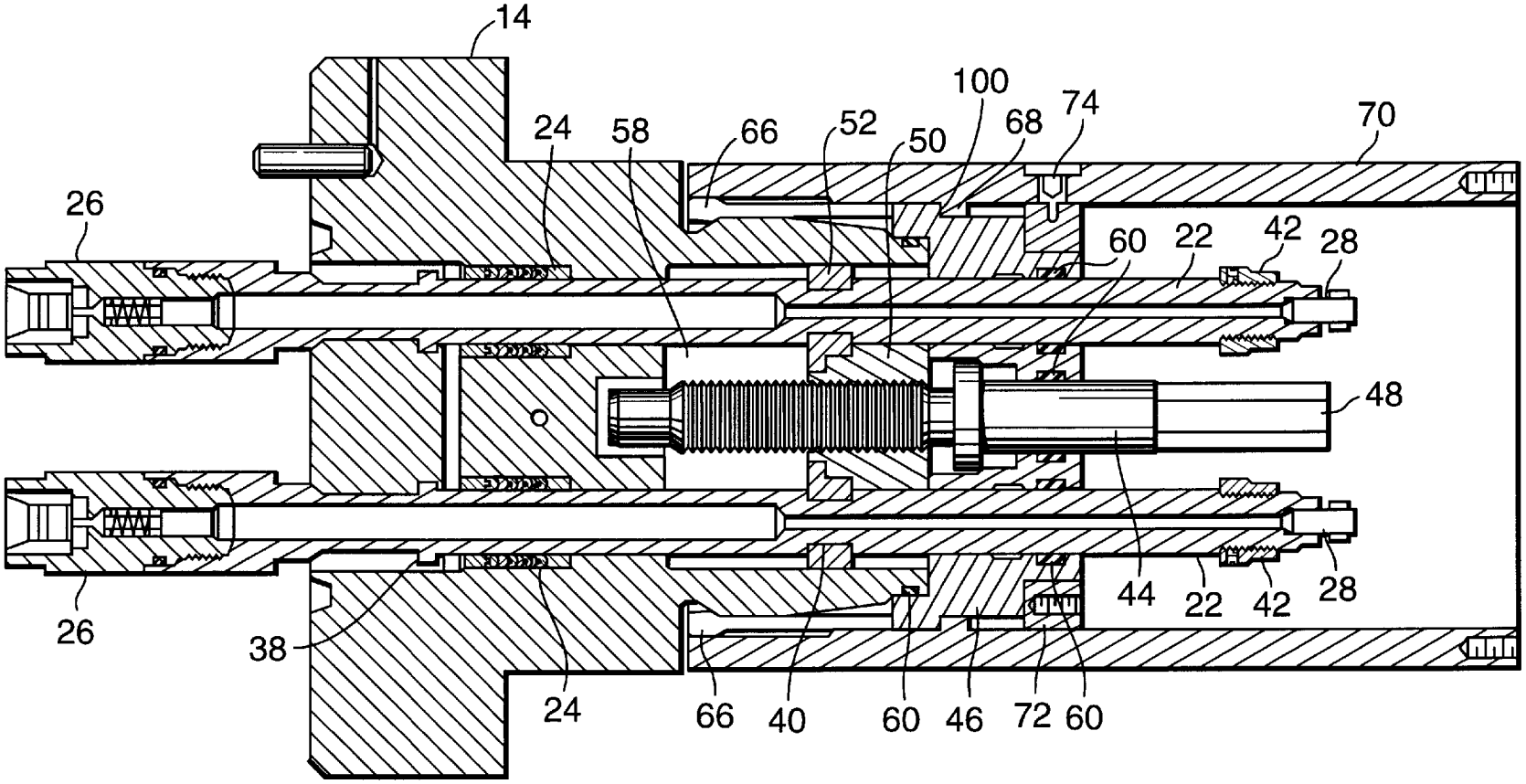
FIG. 6 is an enlarged section on line 2—2 in FIG. 1 showing details of the actuator.

A thrust nut 50 is mounted on the thread of spindle 44 and has a bearing plate 52 bolted to it (FIGS. 6 and 7). As shown in FIG. 5, the bearing plate 52 includes four bayonet apertures each having a large end 54 which will pass over the outer circumference of the stems 22 during assembly, and a small end 56 engageable in the stem thrust grooves 40 by rotating the plate 52 before it is bolted to the nut 50.

The end cap mounting 46 provides locations and bearings to support the stems 22 and drive spindle 44. Seals 60 are provided for the actuator compartment 58 defined between the end cap mounting 46 and main body 14. Compartment 58 has a pressure compensation vessel plumbed to it via a port 62 in the main body 14 to compensate for variations in external hydrostatic pressure and any changes in the free volume of compartment 58 whereby the seals 60 are not exposed to excessive pressure differentials. The compartment 58 also includes a pressure relief valve 64 to protect against damage caused by any leakage of pressure fluid past the packings 24.

The end cap mounting 46 also has features which provide the secondary release mechanism. These include collet fingers 66 which engage over a profile on the main body 14 and react axial loads in the assembly, a forward stop 68 for the retainer sleeve 70 and a thread for mounting a stop ring 72 which reacts the pull load from the retainer sleeve 70 during secondary release of the couplers. Together the forward stop 68 and stop ring 72 form a lost motion connection, as described below. The stop ring 72 also provides holes for shear pins 74 which connect it to the retainer sleeve 70.

The collet fingers 66 are constrained radially by the inner surface of the retainer sleeve 70. During secondary release, the sleeve 70 is pulled to the right as shown in FIGS. 6 and 7, shearing the pins 74 and causing the sleeve 70 to move off the collet fingers 66 freeing them for outward radial movement. The forward stop 68 then contacts the stop ring 72 so that further pulling releases the collet fingers 66 from the body 14. The pull is transmitted through the end cap mounting 46 and through either the primary actuator mechanism or, if this is damaged, the nuts 42, onto the stems 22, thus withdrawing the stems 22 and coupler components 26 from the tubing hanger 30. The retainer sleeve 70 is bolted to an extension sleeve (not shown) terminating in a grab formation at the ROV panel, engageable by a suitable pulling tool on the ROV.

The lines 12*a–d* are preferably formed from metal pipe and have sufficient free length immediately to the rear of the coupler 10 to ensure that they are flexible enough to accommodate the stem connect/disconnect movement. If necessary the lines 12*a–d* can incorporate flexure loops.

Figure 8:
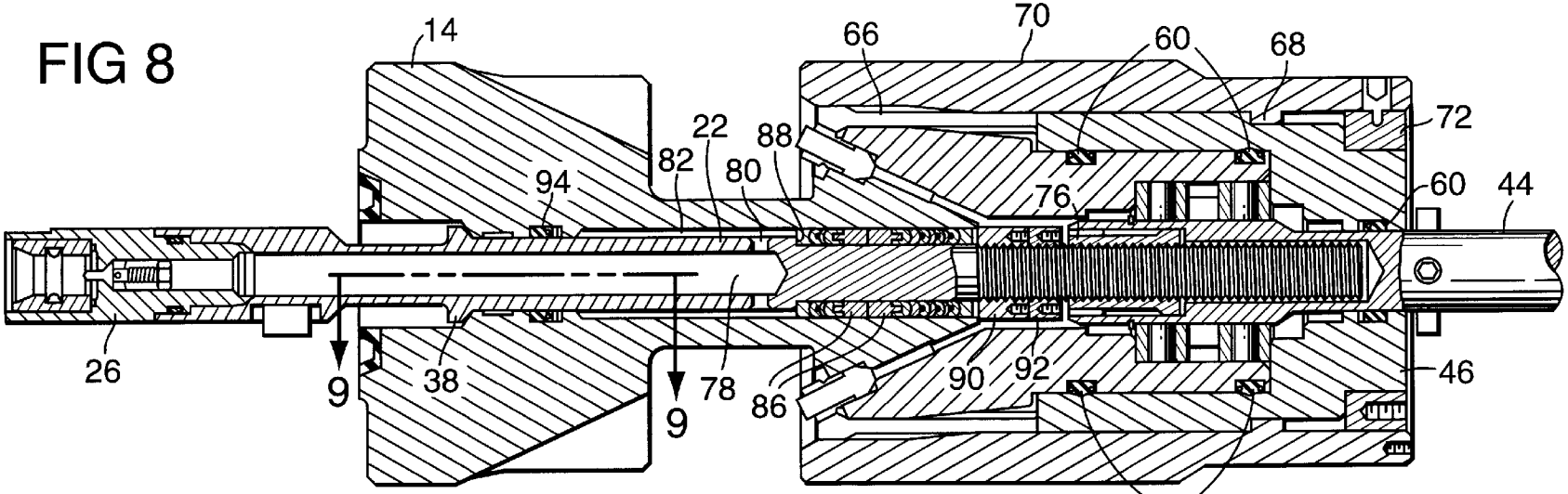
FIG. 8 is a section through a second embodiment.
Figure 9:
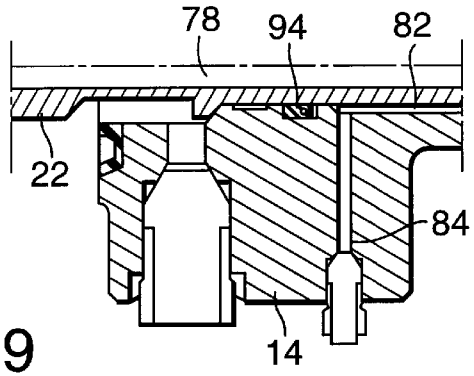
FIG. 9 is a section on line 9—9 in FIG. 8.

FIGS. 8 and 9 show a second embodiment of the invention with a single retractable coupler 26. The stem 22 has an externally threaded end received in an internally threaded sleeve 76 keyed within a hollow end of the drive spindle 44. Fluid communication with the coupler 26 is via a blind ended bore 78 and radial ports 80 in the stem 22 and a chamber 82 and port 84 in the main body 14. The chamber 82 is sealed by a packing assembly 86 mounted on the stem 22 between the ports 80 and the threaded end, retained between a shoulder 88 and backup nuts 90, 92. The chamber 82 is also sealed about the stem 22 at its end closest to the coupler component 26 by a seal element 94.

Various modifications to the foregoing embodiments will be apparent. For example the actuator can be driven by an electric or hydraulic motor, or be replaced by a piston and cylinder device. Such motors or piston and cylinder actuators may include permanently installed power line connections extending to the sea surface, or may include plug-in power connections connectable and disconnectable by a ROV. The collet fingers can be omitted from the end cap mounting 46 which can instead be held on the main body 14 by a shoulder 100 which engages the forward stop 68 on the retainer sleeve 70. This sleeve in turn is mounted on the main body 14 by a screw thread, bayonet or other connection releasable from the main body by the application of torque. The positions of the male and female threaded components in the illustrated actuators can be reversed. In the FIGS. 1–7 embodiment, the bearing plate 52 and bayonet connection apertures can be replaced by simple welded or screw threaded connections or snap rings for retaining the stems on the central actuator component.

What is claimed is:

1. A coupler for a pressure conduit comprising a movable component selectively engageable with and disengageable from a fixed component to provide a disconnectable sealed pressure connection therewith, the movable component being acted upon by a primary actuator connected to a mounting normally held fixed relative to the fixed component but being movable relative to the fixed component to provide secondary actuation of the movable component independently of the primary actuator.

2. A coupler as defined in claim 1 wherein the actuator can be operated for movement by a remotely operated vehicle.

3. A coupler as defined in claim 1 wherein the mounting can be operated for movement by a remotely operated vehicle.

4. A coupler as defined in claim 2 wherein the actuator includes a remotely operable vehicle torque drive connection.

5. A coupler as defined in claim 1 wherein the mounting includes a collet having fingers held in engagement with a fixed body by a retainer sleeve.

6. A coupler for a pressure conduit comprising a movable component selectively engageable with and disengageable from a fixed component to provide a disconnectable sealed pressure connection therewith, the movable component being acted upon by a primary actuator connected to a mounting normally held fixed relative to the fixed component but being movable relative to the fixed component to provide secondary actuation of the movable component independently of the primary actuator;

wherein the mounting includes a collet having fingers held in engagement with a fixed body by a retainer sleeve; and wherein the retainer sleeve is shear-pinned to the collet and also coupled to the collet by a lost motion connection;

whereby pulling on the sleeve will first break the shear pins allowing the sleeve to move and release the fingers for disengagement from the body and then pull the collet from the body by means of the lost motion connection.

7. A coupler for a pressure conduit comprising a movable component selectively engageable with and disengageable from a fixed component to provide a disconnectable sealed pressure connection therewith, the movable component being acted upon by a primary actuator connected to a mounting normally held fixed relative to the fixed component but being movable relative to the fixed component to provide secondary actuation of the movable component independently of the primary actuator;

wherein the actuator can be operated for movement by a remotely operated vehicle;

wherein the actuator includes a remotely operable vehicle torque drive connection; and wherein the actuator comprises a screw threaded spindle or drive sleeve axially fixed for rotation within the mounting and engaging a complimentary drive nut or screw threaded spindle to which the movable component is connected.

8. A coupler as defined in claim 1 comprising a plurality of said fixed components, engageable by a corresponding plurality of said movable components.

9. A coupler as defined in claim 7 wherein the drive nut or spindle carries a bearing plate having bayonet connection apertures engageable with thrust shoulders on the movable components.

10. A coupler for a pressure conduit comprising a movable component selectively engageable with and disengageable from a fixed component to provide a disconnectable sealed pressure connection therewith, the movable component being acted upon by a primary actuator connected to a mounting normally held fixed relative to the fixed component but being movable relative to the fixed component to provide secondary actuation of the movable component independently of the primary actuator;

wherein the coupler comprises a plurality of said fixed components engageable by a corresponding plurality of said movable components; and wherein the movable and fixed components are located in a sealed chamber provided in a Christmas tree and tubing hanger assembly, the chamber providing a backup seal for the coupler.

* * * * *